United States Patent [19]

Klein

[11] Patent Number: 4,997,022

[45] Date of Patent: Mar. 5, 1991

[54] ROLLER DOORS

[75] Inventor: Arno Klein, Hirz-Maulsbach, Fed. Rep. of Germany

[73] Assignee: Labex GmbH Import-Export Industrieanlagen und Foerdertechnik, Bad Honnef, Fed. Rep. of Germany

[21] Appl. No.: 342,294

[22] Filed: Apr. 24, 1989

Related U.S. Application Data

[63] Continuation-in-part of Ser. No. 258,910, Oct. 18, 1988, abandoned.

[30] Foreign Application Priority Data

Oct. 23, 1987 [DE] Fed. Rep. of Germany ..... 3735850
Feb. 21, 1989 [DE] Fed. Rep. of Germany ..... 3905224

[51] Int. Cl.[5] ..... A47H 1/00

[52] U.S. Cl. ..... 160/265; 160/322; 160/300; 242/154; 242/147 R

[58] Field of Search ..... 160/265, 310, 311, 322, 160/189, 190, 303, 300; 242/155 R, 154, 153, 147 R

[56] References Cited

U.S. PATENT DOCUMENTS 2,193,044 3/1940 Sibley ..... 242/147 R X
3,460,602 8/1969 Hugus ..... 160/265

*Primary Examiner*—Blair M. Johnson
*Attorney, Agent, or Firm*—Foley & Lardner

[57] ABSTRACT

A roller door is provided with a flexible door leaf, wound on a winding roller which is mounted rotatably above the door opening. Fast with the winding roller is at least one drum on which there is wound, in contrary direction to the door leaf, a flexible traction member (belt, rope, chain) which is loaded with a counterweight for balancing the weight of the door leaf. In order also to tauten the door leaf, with a separation of the functions of weight compensation and tautening of the door leaf, there is integrally rotatably connected with the winding roller at least one second drum on which is wound, in contrary direction to the door leaf, a further flexible traction member (belt, rope, chain) guided around a guide roller, which is mounted stationarily at the base of the door opening, and connected with the door leaf, and a tensioning roller presses with a transverse force against the portion of the further traction member which runs between its drum and the guide roller.

13 Claims, 10 Drawing Sheets

ROLLER DOORS

This is a continuation-in-Part of U.S. Ser. No. 258,910 filed 10/18/88, now abandoned, of Klein, Arno.

BACKGROUND OF THE INVENTION

In roller doors with a flexible door leaf and with a winding roller for the door leaf, mounted rotatably above the door opening, there has to be provided means for compesating the weight of the door leaf and tensioning means acting on the lower end of the door leaf to tauten the door leaf.

Weight compensation means alone can be provided in a very simple manner, by a drum on one or both sides, connected with the winding roller, rotating integrally therewith and on or from which a traction member winds up or down, in contrary direction to the door leaf on the winding roller, the traction member being loaded with the counterweight to the door leaf. The counterweight can also be suspended on the traction member by means of an idle roller, and the end of the traction member may be connected with the lintel of the door opening (CH-PS 89 785).

For tautening the door leaf it is known to guide the traction member, on which the counterweight is suspended by means of an idle roller, via a guide roller which is mounted rotatably on the lintel of the door opening and via another guide roller which is mounted at the base of the door opening, and to connect said traction member with the door leaf or with a strip which reinforces the lower edge of the door leaf. By way of the limbs of the traction member which run from the idle roller, the weight which is suspended on the idle roller acts on the one hand as the traction force which tautens the door leaf, and on the other hand, via the drum of the traction member, with a torque which is dependent upon the torque which is exerted by the door leaf, with the particular winding radius in question, on the winding roller (DE-PS 23, 41 328). The arrangement of one loose roller on each of the two sides, at the height of the door opening, with a deflection roller at the lintel and a further deflection roller at the base of the door opening, replaces the one loose roller provided in another known arrangement (U.S. Pat. No. 262,398) which is arranged underfloor and pulled downwards by resilient force, and removes the disadvantage which the underfloor arrangement of the roller entails. Irrespective of the arrangement of the loose roller at the height of the door opening or underfloor, and whether or not a weight loading or spring loading of the loose roller is provided, it is difficult to balance out the weight of the door leaf. In U.S. Pat. No. 262,398 the drum for the traction member is of conical shape and has a screw thread for guiding the traction member, whereby in each case the corresponding winding diameter of the door leaf on the coil of the winding-up roller corresponds to the of the traction member on the drum, so that the tensioning roller does not have to balance-out any noteworthy differences of the free length of the traction member. In particular when flat belts are used as traction members because of their long life, there is no possibility of a helical winding because of the drum width thereby occasioned. During the winding of the traction member in layers one over the other—which takes place with inverted tendency in relation to that in the winding of the door leaf—corresponding length-differences have to be balanced out, with corresponding dimensioning of the tensioning device. In so far as comparatively large differences of length have to be compensated, otherwise a free roller which is under weight force or spring force is used or else a constructionally expensive winding device is used, so that therefore it is partially necessary to have a further deflection of the traction member over a fixed roller, to the height of the drop of the door, and a long traction member is necessary, (European patent specification 0276045).

According to German Utility Model 82 06 622, there is additionally provided a spring which is arranged in the winding roller, and which becomes tensioned when the door leaf is being wound up, and which is intended to act simultaneously as a safety device to prevent the door leaf from dropping down. The arrangement of the spring in the winding roller, however, is constructionally expensive and makes maintenance more difficult.

U.S. Pat. No. 3,460,602 discloses a roller door without weight compensation, in which the door leaf is tensioned by springs housed in the door leaf at its foot and connected to traction members wound on the door shaft, extending downwards to guide pulleys and then up to the springs. In this construction the travel of the door leaf and/or the tensioning means are severely restricted.

In German patents 32 45 009, 33 45 016, the weight compensation device and the device for tautening the door leaf were separated from one another, without the constructional expenditure having been reduced and without maintenance having been rendered easier.

An object of the invention is to obtain a robust construction and easier maintenance for the door leaf tautening means, whilst separating the functions of weight compensation and tautening of the door leaf.

SUMMARY OF THE INVENTION

According to the invention there is provided, in a roller door comprising a first winding member rotatable about a horizontal axis; a flexible door leaf wound on the first winding member and hanging therefrom, said door leaf having a lower edge region; winding means for rotating the first winding member for thereby winding the door leaf upwardly onto the winding member and downwardly from the winding member; a second winding member coupled to the first winding member for rotation simultaneously therewith; a flexible traction member wound on said second winding member such that said flexible reaction member winds onto the second winding member as said door leaf unwinds from said first winding member; and guide means guiding said traction member in a path extending from said second winding member downwards to said guide means and thence upwards to said door leaf lower edge region, said traction member being connected to said lower edge region; the improvement comprising tensioning means acting transversely on said traction member in the region between the said guide means and the second winding member for maintaining tension in said traction member and in said door leaf.

In a preferred arrangement there is provided, in addition to a drum which is rotationally connected with the winding roller for the door leaf and on or from which there winds up or down, in contrary direction to the door leaf, a flexible traction member (belt, rope, chain) which for purposes of balancing-out the weight of the door leaf is loaded from example with a counterweight or spring, at least one second drum connected to rotate with the winding roller, on or from which there winds up or down, likewise in contrary direction to the door leaf, a flexible traction member (belt, rope, chain), this traction member being guided around a guide roller which is mounted stationarily at the base of the door opening and being connected with the door leaf or with a strip which reinforces the lower edge of the door leaf, and there is provided a tensioning roller which presses with a transverse force against the limb of the traction member which runs between the drum and the guide roller. It is advantageous if there is provided, on both sides of the winding roller, respective drums for a said weight-balancing traction member and for a said traction member which co-operates with a said tensioning roller.

It will be seen that in the invention, the effective length of the traction member used to keep the door leaf taut, between the point at which this traction member leaves its winding drum and the point at which it is attached to the lower region of the door leaf, is nearly constant. Its effective length varies, if at all, only by a smaller amount due to the changes in the radius of the coil of traction member on its drum and opposite changes in the radius of the coil of door leaf wound on the winding roller. Therefore, the tensioning mechanism acting on the traction member only has to move by a small amount, to compensate for the possible change in the effective length of the traction member, while keeping the traction member and therefore the door leaf taut, as the door leaf is wound up or down. In particular, it is not necessary for the tensioning mechanism to perform movements similar in magnitude to the door leaf. On the other hand, however, by placing the tensioning mechanism so as to act trasnversely on the traction member apart from the door leaf, it is ensured that the tensioning mechanism imposes no restrictions on the design or travel of the door leaf and can itself have adequate travel. The tensioning mechanism provided in accordance with the invention is therefore compact, simple and reliable.

In order to enable bringing the tensioning roller or rollers into an optimum working position, according to a further feature of the invention the drum or drums, for said traction member co-operating with said tensioning roller, is or are connected to the winding roller detachably, and therefore adjustably in the rotational position of the drum or drums relative to the winding roller. For this purpose, as its furthermore provided for according to the invention, the drum or each of these drums can be mounted in loosely rotatable manner on the shaft of the winding roller, a ratchet wheel is connected to rotate with this shaft, and the entrainment of the drum takes place via the ratchet wheel and a pawl which is pivotable about a pin on an end wall of the drum. The ratchet wheel can be constructed such that its axial dimensions are—in accordance with a further feature of the invention—sufficiently wide for the ratchet wheel, in an axially offset second section provided by the extra width, to be capable of co-operating with a second pawl which is pivotable about a pin secured stationarily on the door frame, this pawl being connected with a device which holds it clear but which engages it in the event of an accident.

An advantageous arrangement of the tensioning roller is obtained in that, according to a further feature of the invention, the said roller is mounted at the free end of a lever, about whose bearing axis the guide roller for the traction member is rotatable, and in that on the free end of the lever there is articulated a traction member which is guided over guide rollers and is pulled by a spring or by a weight.

In another embodiment the tensioning means are improved as regards the length differences which are capable of being balanced out, by means of a constructionally simple space-saving design. Specifically, associated with each said belt portion there is a carrier which is pivotably mounted and has oppositely-located eccentrically arranged bearing pins and tensioning rollers which are rotatable on the bearing pins and round which the belt is looped in an S-shape, a crank being rotation-rigidly connected with the pivoting axis of the said carrier, and a spring or a weight being arranged to act on said crank via a tractional connection, for exerting a torque on the pivoting axis and hence the carrier. The tensioning devices thus constructed can be accommodated directly under the winding-roller and the drums connected therewith for winding up the traction members, i.e. in the upper region of the door near to the bearings of the winding-roller, and if necessary they can be combined together to form constructional units. A particularly space saving construction results if, according to a further feature of the invention, the pivoting ranges of the carriers extend from their end positions which effect the lesser shortening of the belts, into the end positions which effect the stronger shortening of the belts and in which the lower tensioning rollers which act upon the belt limbs which run down to the deflecting rollers on the ground, are near to the plane of the door leaf.

BRIEF DESCRIPTION OF THE DRAWINGS

An embodiment example of the invention is illustrated in the drawings, in which.

DESCRIPTION OF PREFERRED EMBODIMENTS

Figure 1:
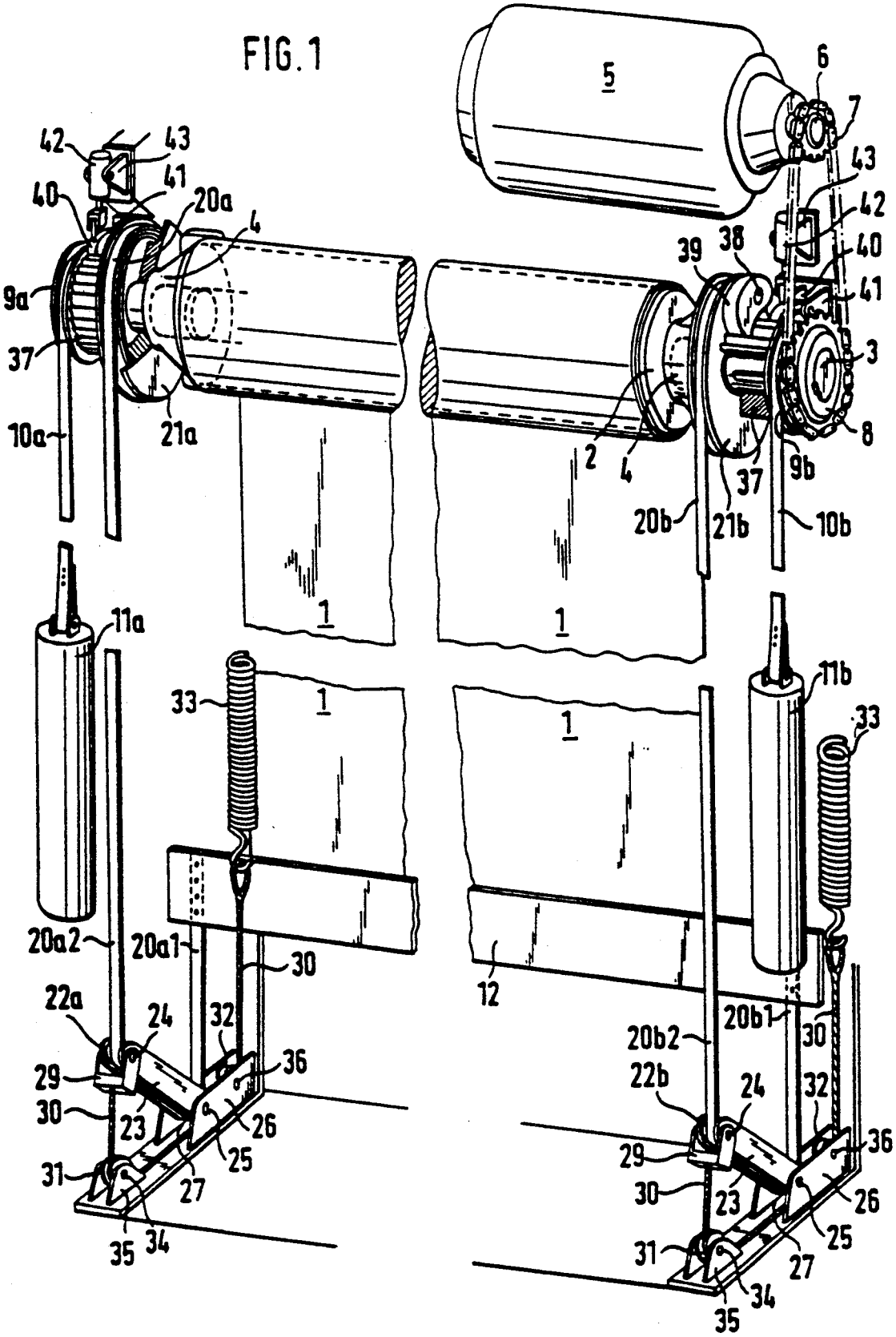
FIG. 1 shows a perspective view of the essential constructional parts of a roller door according to the invention, which is shown on a larger scale in an exploded perspective illustration in FIG. 2A wherein one half is shown, and in FIG. 2B wherein the other half is shown.
Figure 2A:
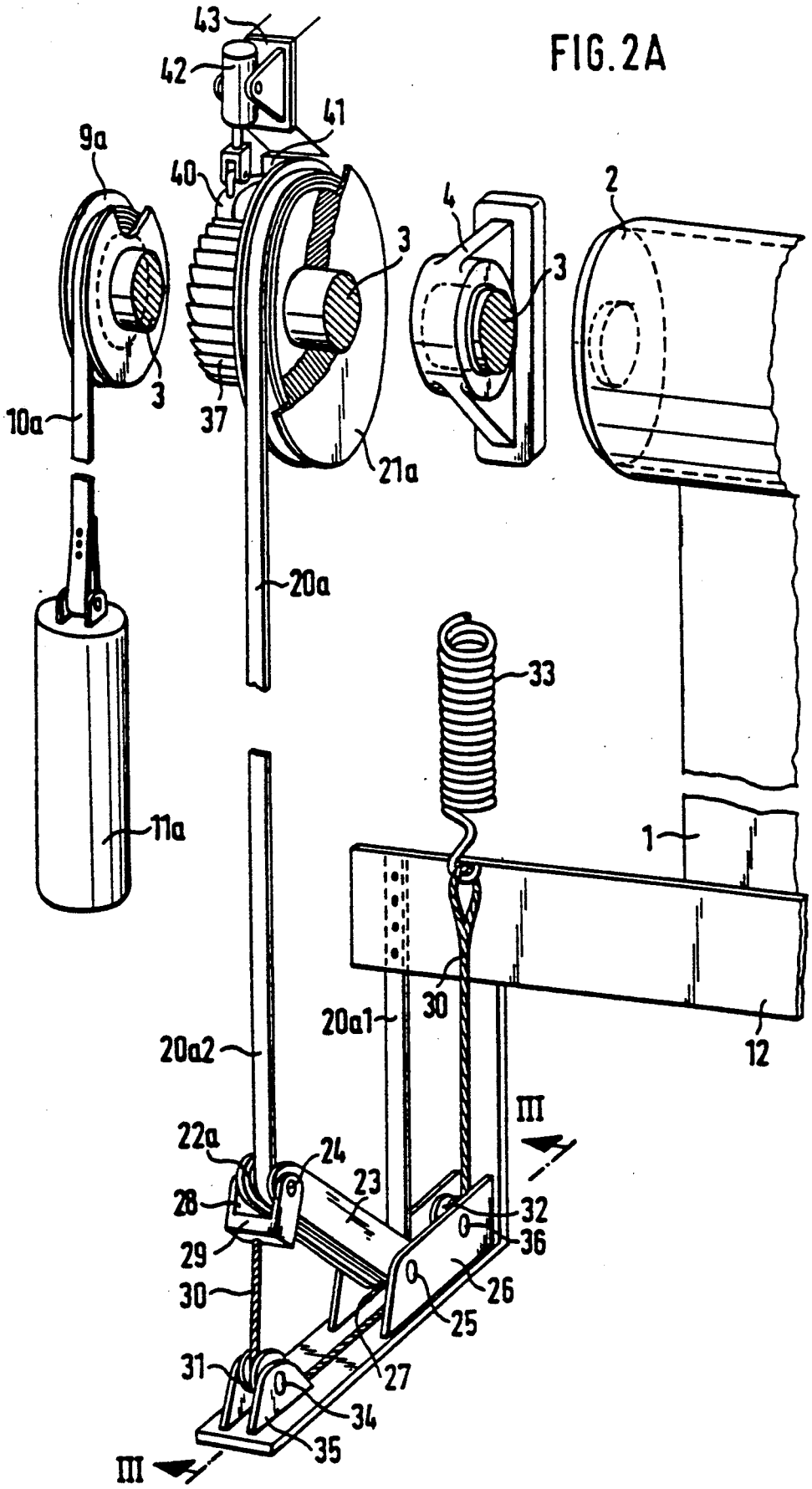
Figure 2B:
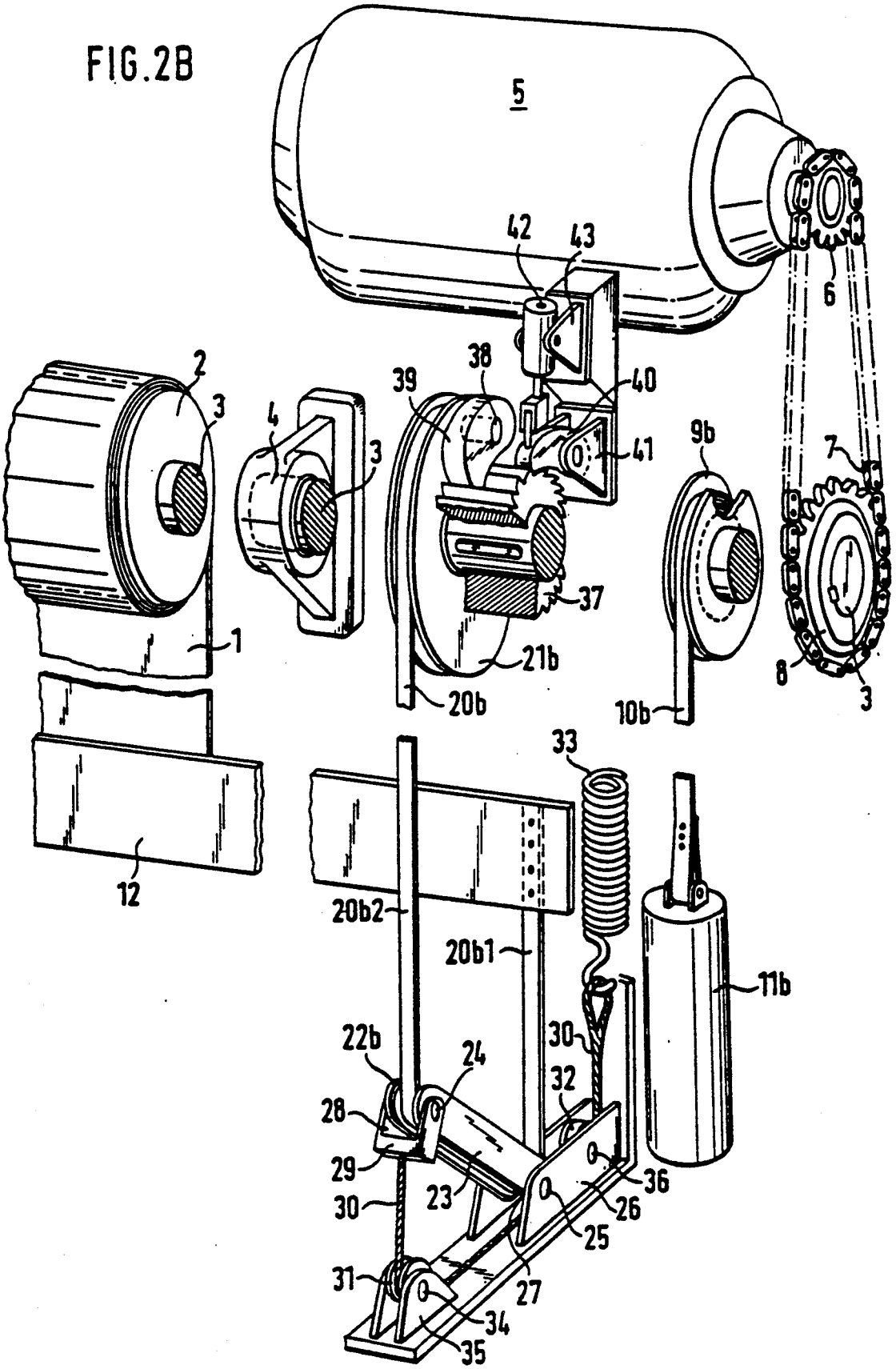
Figure 3:
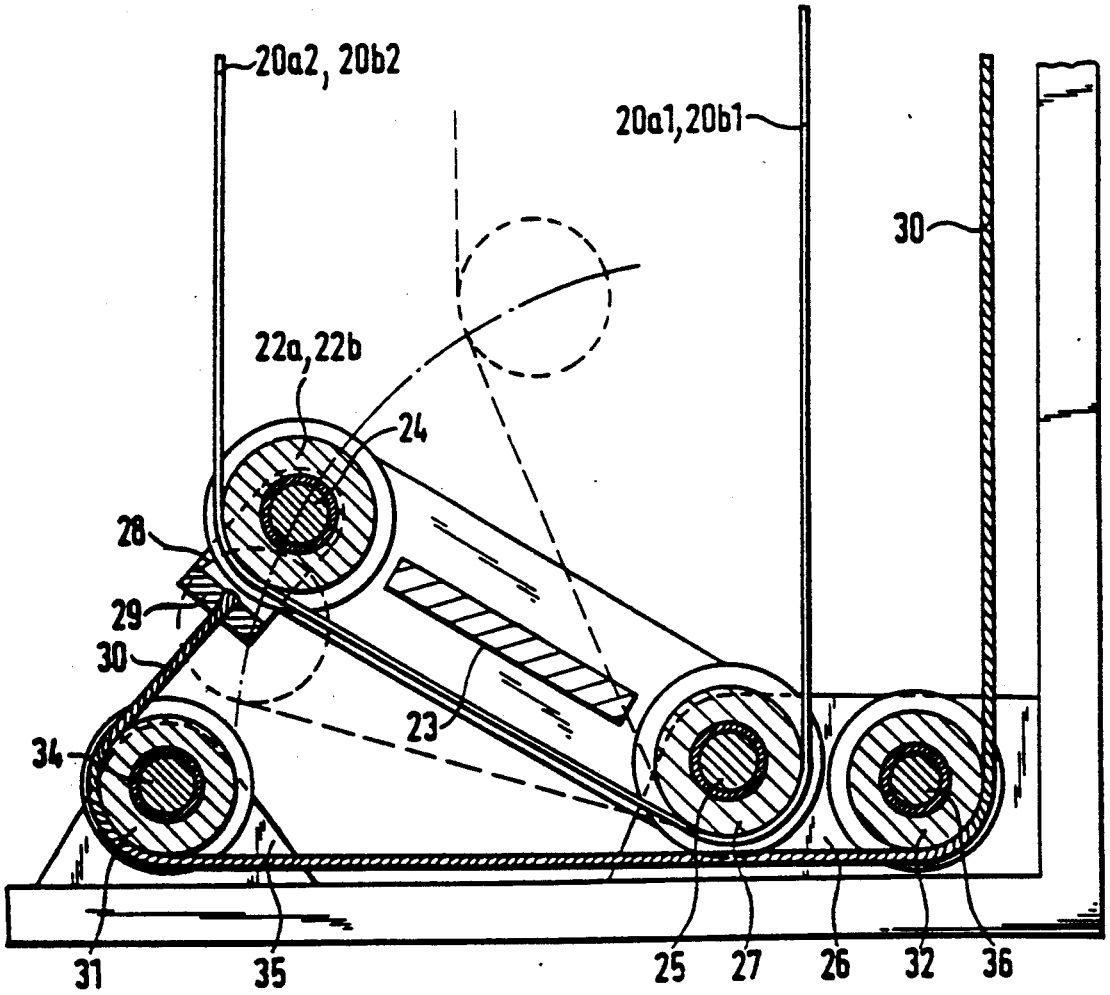
FIG. 3 shows a cut-away view of a detail in cross section along the sectional line III—III depicted in FIG. 2A.

As is shown in particular by FIGS. 1, 2A and 2B, the roller door consists of a door leaf 1 which can be rolled up and which is made preferably from a flexible, if required transparent, synthetic plastics material, and which can be unwound for closing a door opening (not shown). Above the door opening there is rotatably mounted a winding roller 2 for the door leaf 1, for which purpose a shaft 3, integrally rotatably connected with the winding roller 2, is rotatable in bearing blocks 4 which are fastened on a door frame (not shown). For winding the door leaf 1 up and down, a motor 5 is secured on the door frame and drives the winding roller 2 by means of the chain wheel 6 which is secured on its driven shaft, a chain 7, and a chain wheel 8 integrally rotatably connected with the shaft 3. Furthermore, drums 9*a* and 9*b* are integrally rotatably connected with the shaft 3 and therefore also with the winding roller 2. In contrary direction to the web of material 1 on the winding roller 2, belts 10*a* and 10*b* are wound on the drums 9*a* and 9*b*, and on their ends there are suspended counterweights 11*a* and 11*b*. The base diameter of the winding roller 2 and of the drums 9*a* and 9*b*, the thickness of the web of material 1 and of the belts 10*a* and 10*b*, and the counterweights 11*a* and 11*b*, are matched to one another in such a way that the counterweights 11*a* and 11*b* substantially maintain equilibrium in every operating position of the travelling web of material 1.

Figure 4:
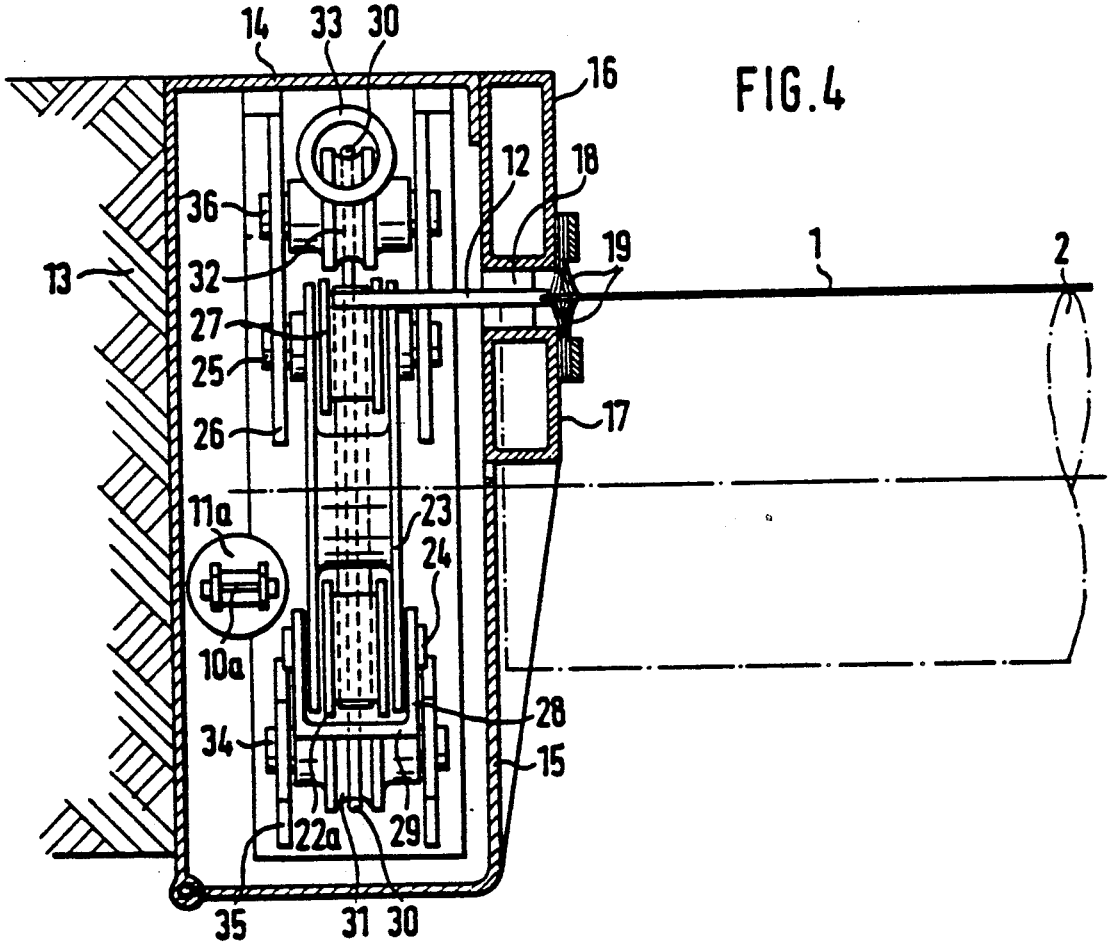
FIG. 4 shows a horizontal section through a doorpost (left hand doorpost in FIGS. 1 and 2A)

The door leaf 1 is provided on its lower edge with a strip 12 for its reinforcement. For guiding the door leaf 1 there are vertical door posts—the left hand one of these door posts being shown in FIG. 4—provided with guide slots or rails for the door leaf. In the present embodiment each door post is formed by a housing part 14 secured in the masonry 13 and by a second housing part 15 which is connected with the housing part 14 in hinge-like manner and completes it so as to form a box profile, the housing parts 14 and 15 here forming a guide slot for the door leaf 1, between profiled strips 16 on the housing part 14 and 17 on the housing part 15. Inserted one over the other into apertures in the reinforcement strip 12 are two guide rollers 18 whose axes are held in the apertures of the reinforcement strip 12 by means of lugs (not shown in the drawings). These guide rollers 18 run between the profiled strips 16 and 17. Brush strips 19, secured on the profiled strips 16 and 17, serve for guiding and in particular for sealing the door leaf 1 between the profiled strips 16 and 17.

In order to keep the door leaf 1 taut, belts 20*a* and 20*b* are provided, which pull the door leaf 1 downwards, by way of the reinforcement strip 12, to which the belts 20*a* and 20*b* are connected. To approximately the same extent as the door leaf 1 moves downwards or upwards, the belts 20*a* and 20*b* are wound up or down by drums 21*a* and 21*b*. The path-length differences resulting from the oppositely-directed changes of the winding diameter for the door leaf 1 on the winding roller 2 and the belts 20*a* and 20*b* on the drums 21*a* and 21*b* are compensated by means of tensioning rollers 22*a* and 22*b* which exert a transverse force on the belts 20*a* and 20*b* and thereby simultaneously produce the traction force in the belts 20*a* and 20*b*, for tautening the door leaf 1.

The tensioning rollers 22*a* and 22*b* are mounted to rotate about axles 24 on the free ends of levers 23. The levers 23 are pivotable about axes 25 which are held by bearing blocks 26. Rotatably arranged on the axes 25 there are also guide rollers 27 for the belts 20*a* and 20*b*, and from the guide rollers 27 the belt limbs 20*a*1 and 20*b*1 extend to the reinforcement strip 12 of the door leaf 1 and the belt limbs 20*a*2 and 20*b*2 extend to the drums 21*a* and 21*b* past the tensioning rollers 22*a* and 22*b*. by means of limbs 28, forked members 29 carry the axles 24 of the tensioning rollers 22*a* and 22*b*. Ropes 30, secured in the forked members 29, run over guide rollers 31 and 32 and are connected at their other ends with tension springs 33 which produce the transverse force which is to exerted by the tensioning rollers 22*a* and 22*b* on the limbs 20*a*2 and 20*b*2 of the belts 20*a* and 20*b*. The springs 33 are provided with adjustment means (not shown) for adjusting their tensioning force, and are suspended in brackets (likewise not shown) on the vertical doorposts. The guide rollers 31 are rotatable about axles 34 in bearing blocks 35, and the guide rollers 32 are rotatable about axles 36 in the bearing blocks 26. Springs 33 may be replaced by weights.

The optimum setting of the tensioning rollers 22*a* and 22*b* with regard to their working range during compensation of the path-length difference between the door leaf 1 and the belts 20*a*and 20*b* is made possible in that the drums 21*a* and 21*b* are adjustable and securable in their rotational position in relation to the winding roller 2. This is achieved in that the drums 21*a* and 21*b* are mounted rotatably on the shaft 3, whilst ratchet wheels 37 are fast with the shaft 3. The drums 21*a* and 21*b* are provided, on the end walls which face towards the ratchet wheels, with pins 38 and with pawls 39 which are mounted pivotably on the pins 38 and which are pressed by springs (not shown) against the ratchet wheels and permit the drums 21*a* and 21*b* to be rotated relative to the winding roller 2.

The ratchet wheels 37 have an axial dimension such that in a second track beside the pawls 37, pawls 40 can be arranged, which are mounted pivotably in bearing blocks 41 secured on the vertical doorposts. A releasing device 42 mounted in a bearing block 43 holds the pawls 40 in the released position and brings the pawls 40 into engagement, in the event of an accident or emergency, with the aid of a control means (not shown), whereby further downwards movement of the door leaf 1 is prevented.

The invention has been described above with reference to a preferred embodiment, but it is to be understood that modifications, variations and additions can be made within the spirit and scope of the invention.

For example, in the described embodiment the winding drums for the belts for the counterweights and tensioning springs are coaxial with the main winding roller. Either or both of these winding drums may alternatively be placed differently, and connected to the winding roller or drive motor through suitable transmission means. The winding drums for the tensioning belts may be fast with the main winding roller instead of being adjustable relative to it. Tensioning force may be applied to the tensioning belt in any convenient way, for example by tensioning a movable guide roller about which the lowest portion of this traction member is deflected.

Figure 5:
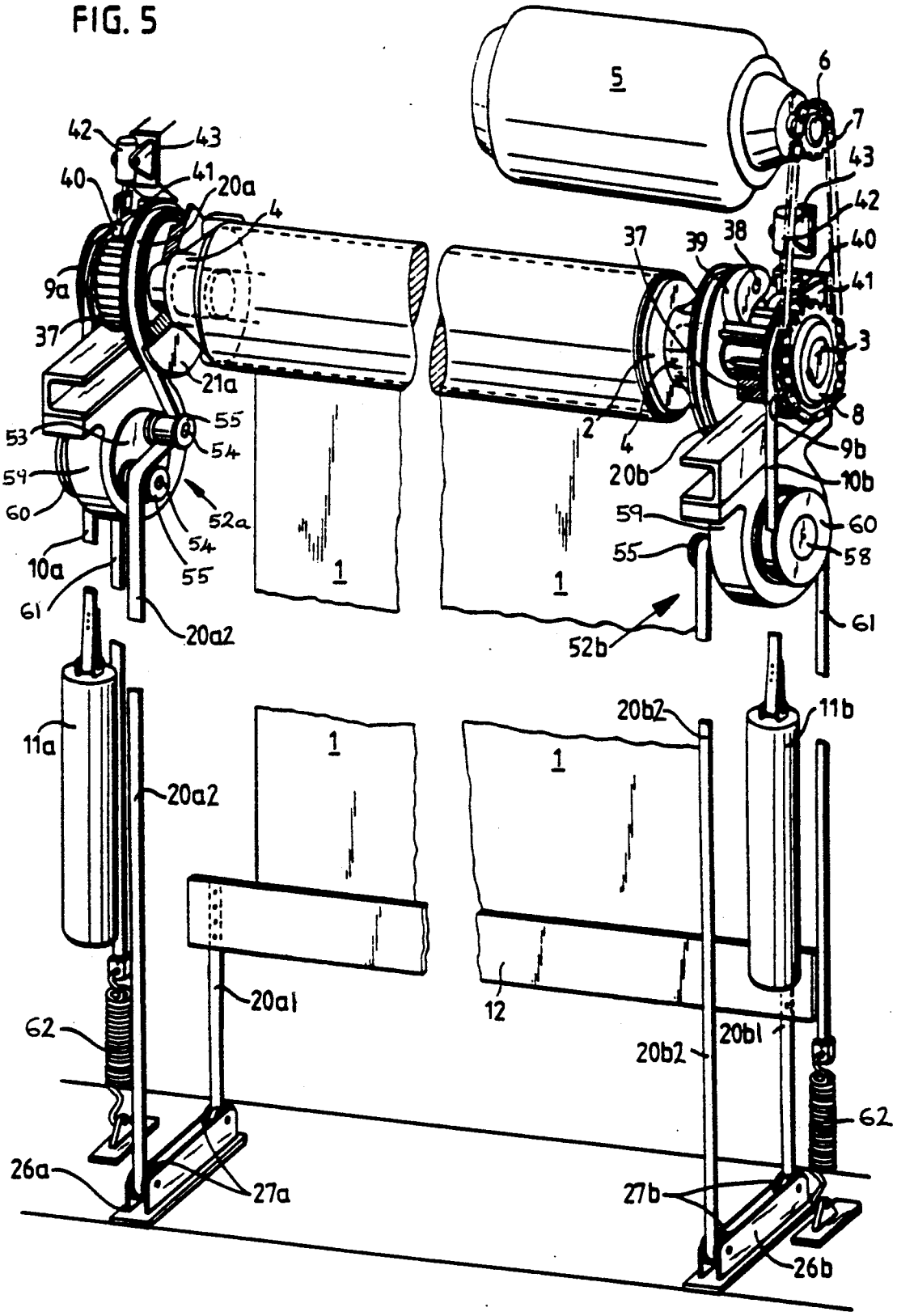
FIG. 5 shows in perspective illustration a second embodiment.
Figure 6:
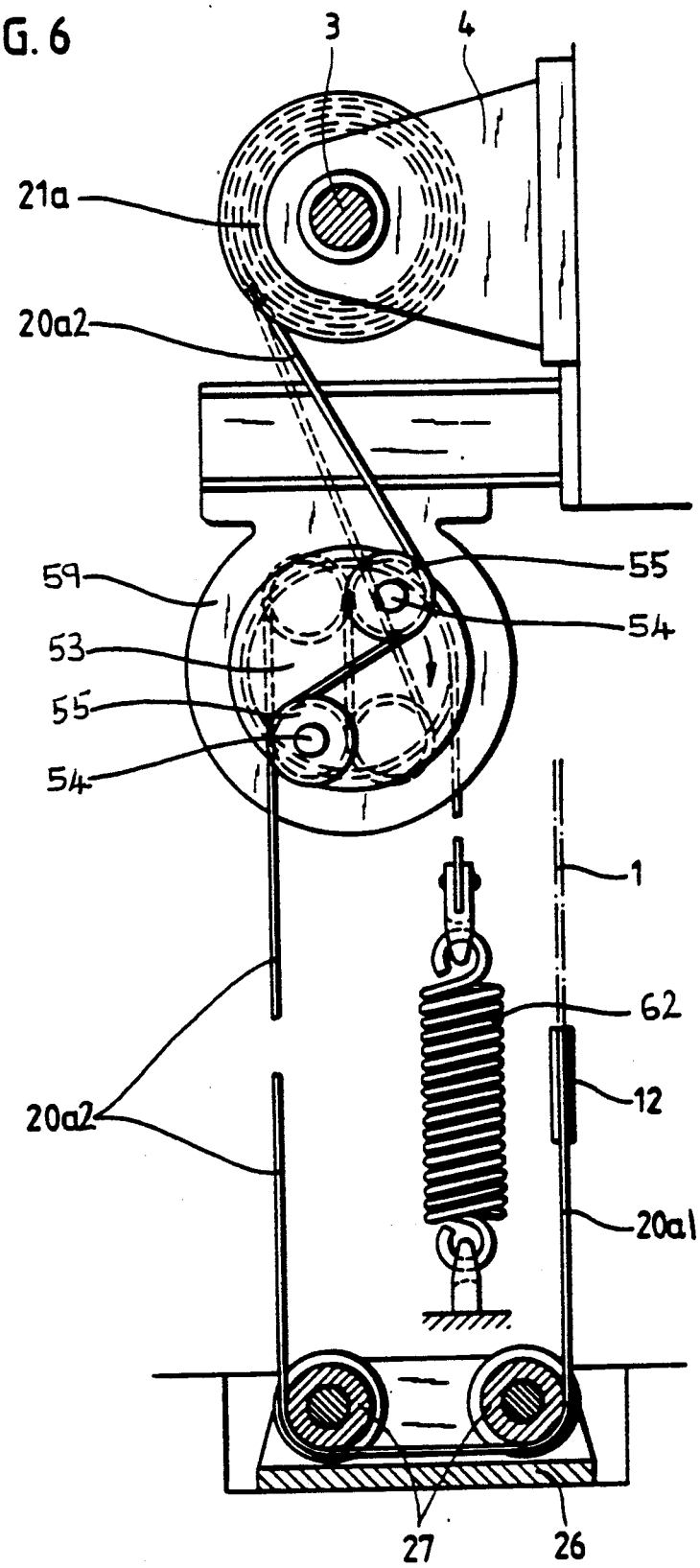
FIG. 6 is a cut-out view of the second embodiment as a section along the line II—II drawn in FIG. 7
Figure 7:
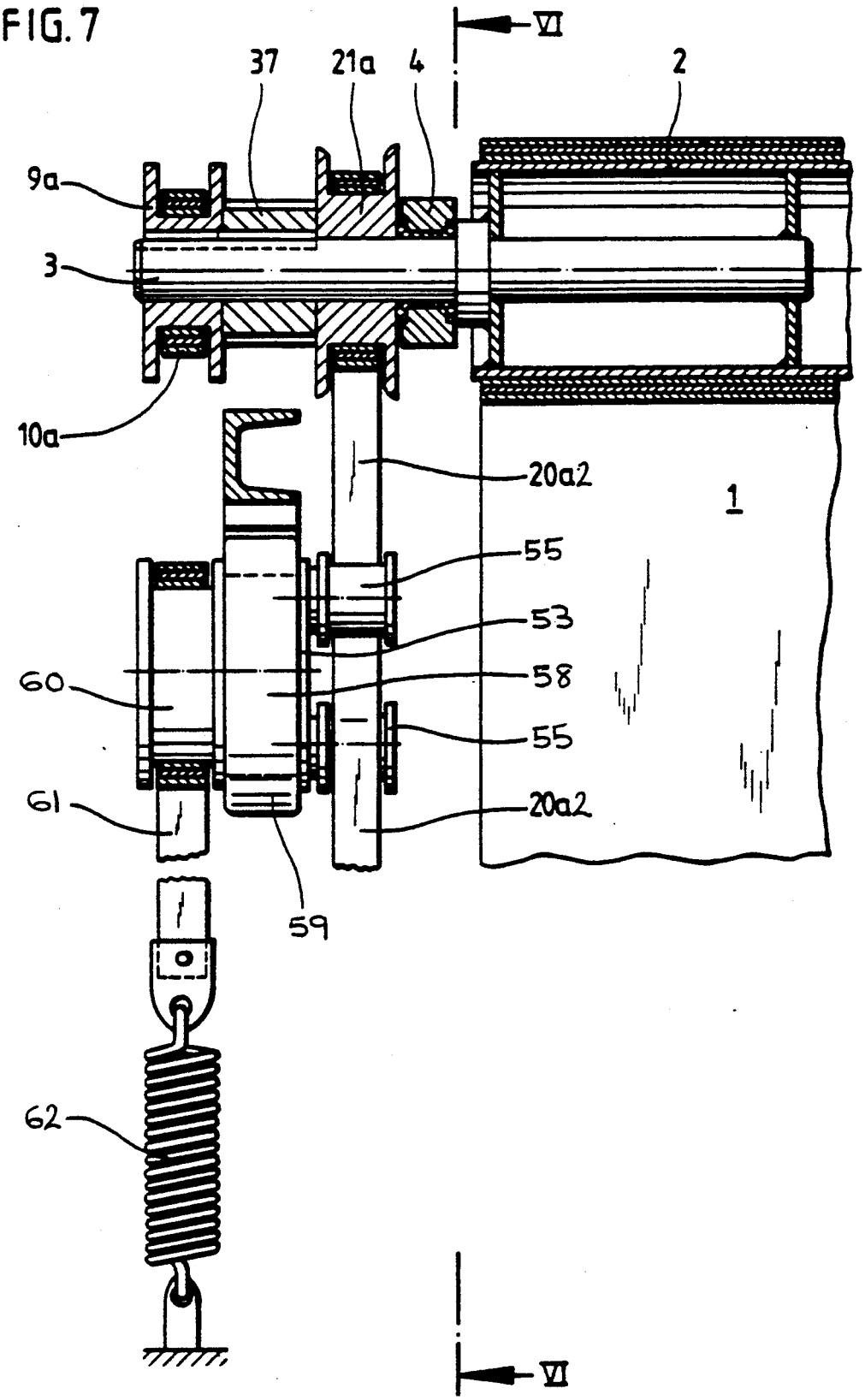
FIG. 7 shows the second embodiment in cut-out elevation.

In the embodiment illustrated in FIGS. 5 to 7, the elements, corresponding to those shown in FIGS. 1–4 are identified by the same references and will not be described again.

In FIGS. 5–7 the belts 20*a* and 20*b* are wound up or down by drums 21*a* and 21*b* and are guided around deflecting rollers 27*a*, 27*b* rotatable in bearing blocks 26*a*, 26*b* on the ground, with belt limbs 20*a*2, 20*b*2 between the drums 21*a* and 21*b* and the deflecting rollers 27*a*, 27*b*, and also belt limbs 20*a*1, 20*b*1, between the deflecting rollers 27*a*, 27*b* and the reinforcing strip 12. The belts 20*a* and 20*b* are wound up or down by the drums 21*a* and 21*b* to approximately the same extent as the door leaf 1 is moved down or up. The path differences which arise from the contra-directional alterations of the winding diameter for the door leaf 1 on the winding-roller 2 and of the belts 20*a* and 20*b* on the drums 21*a*and 21*b* are compensated by tensioning devices 52*a* and 52*b*, which act upon the belt limbs 20*a*2, 20*b*2. Each tensioning device 52*a*, 52*b*, consists of a carrier 53 on which are arranged two eccentric bearing pins 54 with rotatably mounted tensioning rollers 55. Each carrier 53 is rotatable in a bearing 59 with a shaft journal 58. Rotationally rigid on the shaft journal 58 there is in each case a crank disc 60. A torque is exerted upon the shaft journal 58 with carrier 53, by means of a belt 71 wound around the crank disc 60 and a traction spring 62, or by means of a weight suspended on the belt 61, by which torque the belt limb 20*a*2 and/or 20*b*2, which is guided in S-shape around the clamping rollers 55, is held under tension. Tension also is effected in the belt limbs 20*a*1, 20*b*1 by means of the deflecting rollers 27*a* and/or 27*b*, and thus the door leaf 1 is kept taut by way of the reinforcing strip 12.

The optimum setting of the tensioning devices 52*a* and 52*b* with regard to their working range during the compensating of the path difference between the door leaf 1 and the belts 20*a* and 20*b* is made possible in the same manner as in the embodiment of FIGS. 1–4.

Figure 8:
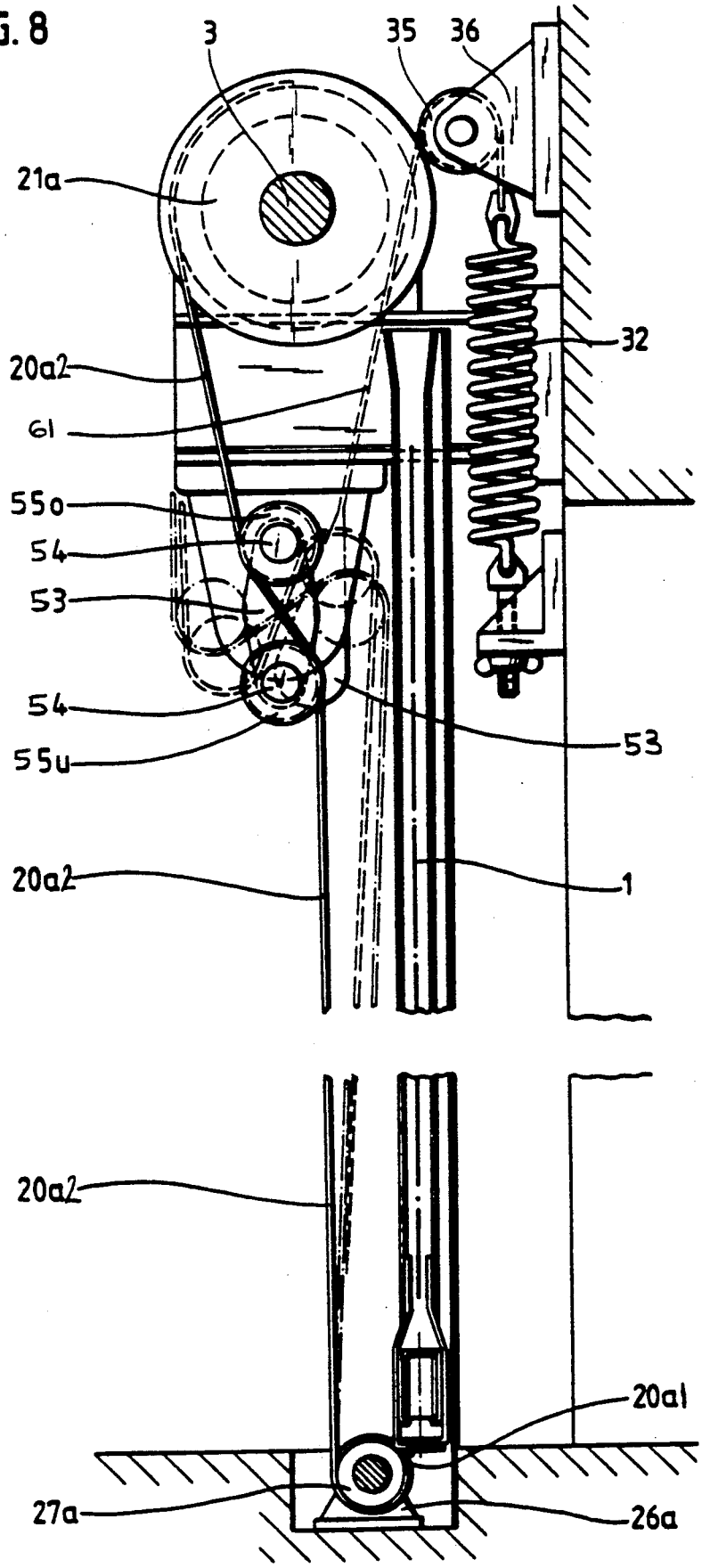
FIG. 8 shows a third embodiment in section along the line IV—IV drawn in FIG. 9.
Figure 9:
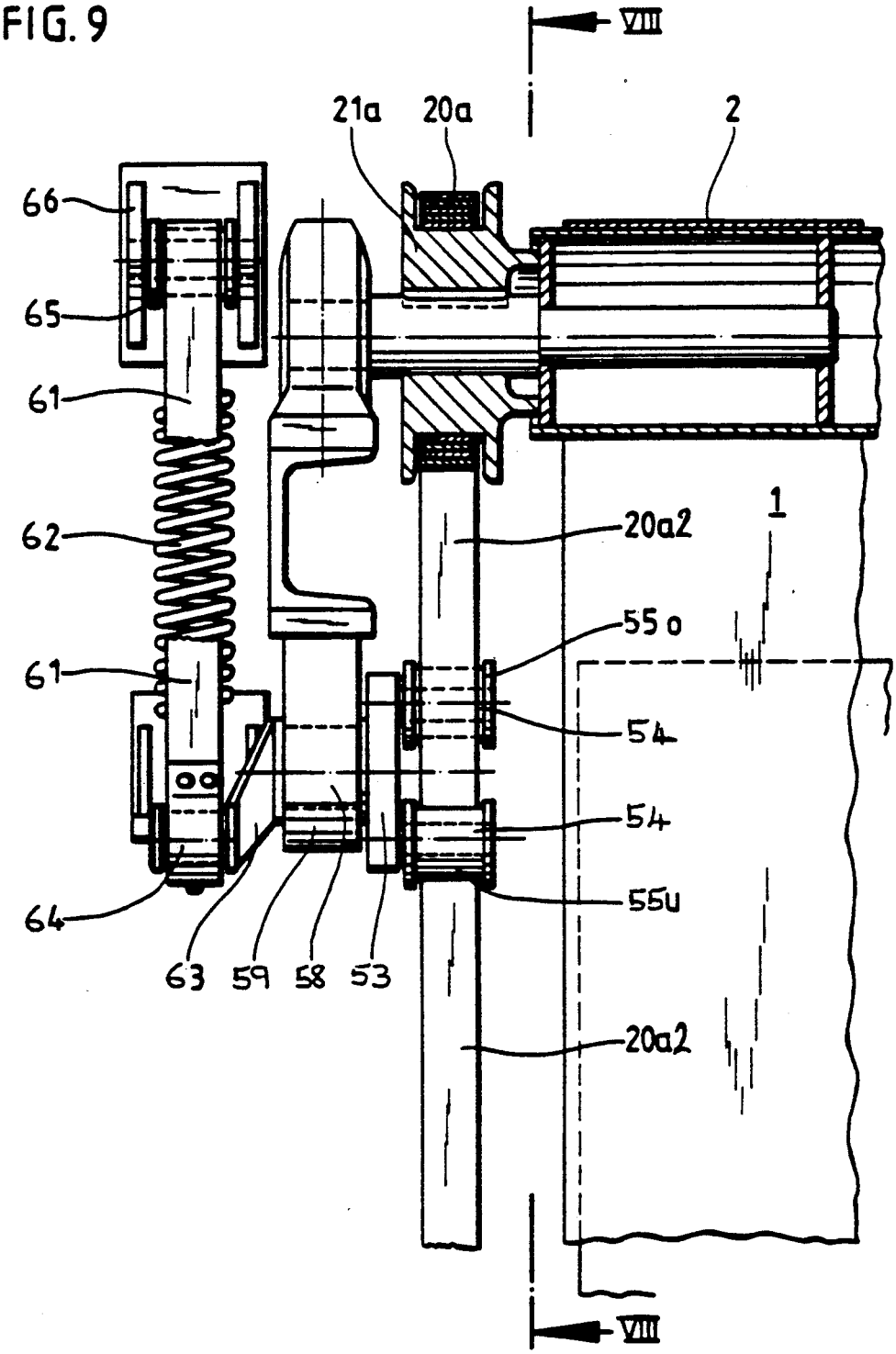
FIG. 9 is an elevational view of this third embodiment.

The embodiment of the invention shown in FIGS. 8 and 9 corresponds substantially to that according to FIGS. 5 to 7, for which reason the constructional parts which correspond to one another are provided with the same reference numerals, and no further description thereof is given. In modification of the embodiment according to FIGS. 5 to 7, in the embodiment according to FIGS. 8 and 9 a crank arm 63 with crank pin 64 is provided instead of crank disk 60. The belt 61 which is secured on the crank pin 64 and is connected with the traction spring 62 in this case is guided over a deflecting roller 65 in a bearing block 66, in order to permit a space-saving arrangement of the traction spring 62. However, space is saved particularly because the tensioning rollers 55*u*, which act upon the belt limbs 20*a*2 or 20*b*2 running downwards towards the deflecting roller 27*a* and/or 27*b*, have their pivoting region nearer to the plane of the door leaf 1 than do the tensioning rollers 55*o*, which act upon the belt limbs 20*a*2 and/or 20*b*2, which run upwards towards the drum 21*a* and/or 21*b*.

The described embodiments use counterweights 11*a*, 11*b* to compensate the weight of the door leaf. Such counterweights have substantial inertia due to their mass, and therefore their response to movement of the door leaf is not instantaneous. If the door leaf is very strongly accelerated when being lowered, the weights' action upon the door leaf may, for a short time, be partially removed or even entirely removed. Therefore it may be of advantage to use, instead of the weights, spring force, which is practically independent of mass. The spring force which changes with the spring path can be balanced-out by corresponding dimensioning of the winding diameter on the drums 9*a*/9*b*.

An important feature of the invention is the construction of the tensioning devices whereby the tautening of the door leaf is maintained, whereas the means provided for compensating/balancing the weight of the door leaf can be modified or can even (in certain circumstances) be entirely dispensed with; thus for example the counterweights and rums 9 may be omitted, the safety devices 40–43 however being retained.

What is claimed is:

1. In a roller door comprising a first winding member rotatable about a horizontal axis; a flexible door leaf wound on the first winding member and hanging therefrom, said door leaf having a lower edge region; winding means for rotating the first winding member for thereby winding the door leaf upwardly onto the winding member and downwardly from the winding member; a second winding member coupled to the first winding member for rotation simultaneously therewith; a flexible traction member wound on said second winding member such that said flexible traction member winds onto the second winding member as said door leaf unwinds from said first winding member; and guide means guiding said traction member in a path extending from said second winding member downwards to said guide means and thence upwards to said door leaf lower edge region, said traction member being connected to said lower edge region; the improvement comprising tensioning means disposed independently from said lower edge region and acting transversely and indirectly on said traction member in the region between the said guide means and the second winding member for maintaining tension in said traction member and in said door leaf.

2. In a roller door comprising a first winding member rotatable about a horizontal axis; a flexible door leaf wound on the first winding member and hanging therefrom, said door leaf having a lower edge region; winding means for rotating the first winding member for thereby winding the door leaf upwardly onto the winding member and downwardly from the winding member; a second winding member coupled to the first winding member for rotation simultaneously therewith; a first flexible traction member wound on the second winding member such that the first flexible traction member winds onto the second winding member as the door leaf winds off the first winding member, and vice versa; and a weight-balancing means acting on said first traction member for counterbalancing the weight of the door leaf; the improvement comprising a third winding member coupled to the first winding member for rotation simultaneously therewith; a second flexible traction member wound on said third winding member such that said second flexible traction member winds onto the third winding member as said door leaf unwinds from said first winding member; guide means guiding said second traction member in a path extending from said third winding member downwards to said guide means and thence upwards to said door leaf lower edge region, said second traction member being connected to said lower edge region; and tensioning means disposed and transversely acting on said second traction member apart from said lower edge region for maintaining tension in said second traction member and in said door leaf.

3. The door of claim 2 in which said tensioning means is arranged to act transversely on said second traction member in the portion of said member extending between said guide means and said third winding member.

4. The door of claim 2 in which said first, second and third winding members are disposed coaxially.

5. A roller door with a flexible door leaf, which can be wound upon a winding roller which is mounted rotatably above the door opening, characterized in that at least one drum is connected to rotate with the winding roller, on or from which there winds up or down, in contrary direction to the door leaf, a flexible traction member in that this traction member is guided around a guide roller which is mounted stationarily at the base of the door opening and is connected iwth the door leaf and in that at least one tensioning roller spaced apart from said door leaf is provided, which presses with a transverse force against the portion of the said traction member which is running between the said drum and the guide roller.

6. A roller door with a flexible door leaf, which can be wound up on a winding roller which is mounted rotatably above the door opening and with which there is integrally rotatably connected at least one first drum, on or from which there winds up or down, in contrary direction to the door leaf on the winding roller, a flexible first traction member which is loaded for balancing-out the weight of the door leaf, characterized in that at least one second drum is connected to rotate with the winding roller, on or from which there winds up or down, likewise is contrary direction to the door leaf, a flexible second traction member in that this traction member is guided around a guide roller which is mounted stationarily at the base of the door opening and is connected with the door leaf and in that at least one tensioning roller spaced apart from said door leaf is provided, which presses with a transverse force against the portion of the second traction member which is running between the said second drum and the guide roller.

7. A roller door according to claim 6, characterised in that at each end of the winding roller there is provided a respective first drum and a respective second drum.

8. A roller door according to claim 6 characterised in that the said second drum is connected releasably with the winding roller and is adjustable in the rotational position of the drum in relation to the winding roller.

9. A roller door according to claim 8, characterised in that the said second drum is mounted in loosely rotatable manner on the shaft of the winding roller, whilst a ratchet wheel is connected rotationally fast with this shaft and entrainment of the said second drum takes place through the ratchet wheel and a pawl which is pivotable on an end wall of said drum.

10. A roller door according to claim 9, characterised in that the ratchet wheel co-operates, in an axially offset second section, with a second pawl which is pivotable about a stationary pivot, the second pawl being connected with a device which normally releases it but which engages in the event of interference.

11. A roller door according to claim 6, characterised in that a said tensioning roller is mounted at the free end of a lever, about whose bearing axis the guide roller for the traction member is rotatable, and in that at the free end of the lever there is connected a traction member which is guided over guide rollers and is pulled by a tension-exerting element.

12. A roller door according to claim 6 in which two said tensioning rollers are provided eccentrically on a rotatable carrier, said portion of said second traction member passing round said two tensioning rollers in an S-shaped path, and in which means are provided exerting torque on said carrier thereby causing said two tensioning rollers to tension said second traction member.

13. A roller door according to claim 12 in which the rotatable carrier has a range of rotation extending from a first end position in which said S-shaped path effects a minimum shortening of said traction member to a second end position in which said S-shaped path effects a maximum shortening of said second traction member, and in said second end position the said tensioning roller that acts on the traction member limb extending downwards to said guide roller is disposed adjacent the plane of the door leaf.

* * * * *